US006976946B2

(12) United States Patent
Wied et al.

(10) Patent No.: US 6,976,946 B2
(45) Date of Patent: Dec. 20, 2005

(54) MODULAR POUCH MACHINE

(75) Inventors: Randy C. Wied, Green Bay, WI (US); Gaylord Guilette, Luxemburg, WI (US); Scott A. Mattila, Green Bay, WI (US); David Thomas, Appleton, WI (US); Mark Krueger, Green Bay, WI (US); Gerald R. Winiecki, Suring, WI (US); Gary Sargin, Green Bay, WI (US)

(73) Assignee: CMD Corporation, Appleton, WI (US)

( * ) Notice: Subject to any disclaimer, the term of this patent is extended or adjusted under 35 U.S.C. 154(b) by 0 days.

(21) Appl. No.: 10/837,544

(22) Filed: Apr. 30, 2004

(65) Prior Publication Data

US 2005/0003941 A1 Jan. 6, 2005

Related U.S. Application Data

(63) Continuation of application No. 09/840,370, filed on Apr. 23, 2001, now abandoned.

(51) Int. Cl.[7] ..... B31B 1/00
(52) U.S. Cl. ..... 493/3; 493/8
(58) Field of Search ..... 493/3, 8, 13, 14, 493/15, 17, 18, 21, 22, 23; 53/51, 52, 64

(56) References Cited

U.S. PATENT DOCUMENTS 4,611,799 A * 9/1986 Nuttin ..... 493/410
5,086,964 A * 2/1992 Blaser ..... 226/108
5,181,365 A * 1/1993 Garvey et al. ..... 53/562
5,417,638 A * 5/1995 Anderson et al. ..... 493/11
5,537,798 A * 7/1996 Fukuda et al. ..... 53/55
5,971,905 A * 10/1999 Fukuda ..... 493/3
6,004,252 A * 12/1999 Blaser ..... 493/3
6,139,479 A * 10/2000 Heiliger ..... 493/8
6,195,967 B1 * 3/2001 Todd et al. ..... 53/64
6,217,497 B1 * 4/2001 Laudenberg ..... 493/22
6,247,293 B1 * 6/2001 Todd et al. ..... 53/51
6,319,182 B1 * 11/2001 Schneider ..... 493/13
6,381,919 B2 * 5/2002 Todd et al. ..... 53/64

* cited by examiner

*Primary Examiner*—Louis K. Huynh
*Assistant Examiner*—Michelle Lopez
(74) *Attorney, Agent, or Firm*—George R. Corrigan

(57) ABSTRACT

A pouch machine includes a controller and first and second modules. Each module has a converting station and the electrical equipment needed to operate the station. The controller controls the converting stations and operating parameters are provided from one module to the next. Each module may be a processing zone and include a registration sensor and a drawroll responsive to the respective registration sensor. Accumulators may be provided in each processing zone. An edge sensor may be provided that senses the edge of the film in one or more modules. The draw roll assembly is mounted on a moveable frame, and is angled in response to the location of the sensed edge. Multiple such assemblies may be included on a single machine.

6 Claims, 4 Drawing Sheets

MODULAR POUCH MACHINE

This application is a continuation of U.S. patent application Ser. No. 09/840,370, filed on Apr. 23, 2001, now abandoned.

FIELD OF THE INVENTION

The present invention relates generally to the art of bag making. More specifically, it relates to pouch-type bag making.

BACKGROUND OF THE INVENTION

There are a wide variety of bag making machines, and a number of known pouch machines. Pouch machines may have continuous or intermittent motion, and have a generally horizontal or vertical machines film path. In either case a continuous web of material or film is converted into a series of individual pouches. Generally, the continuous film is folded in half over a plow or forming shoulder. The folded web is transported through at least one cross-sealer, which has seal bars in the cross-machine direction, to form cross seals, thus creating a strip of pouches interconnected by transverse seals (and open opposite the fold). A cut-off unit separates the continuous film into individual pouches by cutting each cross-seal. Individual pouches are subsequently filled and sealed at a separate machine.

Prior art intermittent motion pouch machines alternately advance the film, and then the various processing stations process the film when it is stationary (the dwell time). Examples of such pouch machines include. U.S. Pat. Nos. 5,181,365 and 6,195,967 (hereby incorporated by reference).

Pouch machines perform a number of processes in addition to the sealing and cutting described above that form the pouch, such as forming a zipper seal (or weld) on a film, forming a long seal (machine direction) on the film, and applying a "slider" closure on the film. One or more of these processes, along with feeding/folding the film, forming cross-seals, and separating adjacent pouches are performed in succession, and, depending on what process are performed, any of a variety of pouch style may be made.

Typically, the machinery performing the processes are housed in a single structure (called a cab or cabinet). A single controller controls the entire process and all of the needed machinery. The controller is typically housed in a separate structure. Such a pouch machine has one common electrical control cabinet housing the complete electrical requirements for the complete specialized machine line. This makes for an inflexible, limited product range machine, and its expensive to change product styles.

For example, when a pouch manufacturer desires to make a particular style pouch, the machinery needed to perform the required processes is determined, and a specialized machine, including a controller, is built. If the pouch manufacturer desires to make a different style pouch a new machine must be built, or the existing machine must be disassembled, and then rebuilt with the appropriate machinery and controls.

Another type of prior art pouch machine provides for modules which each house machinery for a specific task, rather than a single cab. A single central controller is provided to control each of the various modules. Changing pouch styles requires changing modules, and rewiring of the controller, and possibly a redesign of the controller so that it can control the new modules.

Such prior art machines are not readily modified to produce pouch styles other than those for which the machine was originally built. Accordingly, a pouch machine that can be readily altered to produce different pouch styles is desirable.

Pouch machines are typically 30 or more feet in length due to the great number of processes that have to be done to the web. The film or web is drawn through the machine by a single drawroll assembly. The drawroll is registered to a registration mark on a film. An example of such a prior art machine is found in U.S. Pat. No. RE 35,067, hereby incorporated by reference. Some prior art machines have dual drawroll systems, such as that described in U.S. Pat. No. 5,086,964 (hereby incorporated by reference). Such a system uses one drawroll for registration and the other drawroll for advancing the web and setting web tension between the drawrolls.

Given the length of the machine, it is typical for the registration to be off at some of the processing stations, particularly those a greater distance from the registration sensor. Thus, prior art pouch machines provide that the machinery or tooling that performs the process on the web (cross sealing, punching, die cutting, etc.) are each on an independent carriage that is moved to the position of the stopped web to accurately register the process to the web, film, mark, seal, etc.

Accordingly, a pouch machine that does not require processing devices to be moved along the machine direction for proper registration is desirable.

Pouch machines in the prior art includes web guides. Generally, such guides were developed for use with continuous motion machines and the guides were separate from the rolls drawing or driving the film or web. The web guides were needed because the web often tracked toward one side of the machine or the other. This may be caused by misalignment of drawrolls, sections of the machine being out of proper alignment with each other, material which is thicker on one edge of the web than the opposite edge or stretched material. Whatever the cause, it is important to keep the web tracking properly through the machine.

FIG. 3 shows such a prior art web guide system that includes guide roller or rollers 320 moving in a lateral and angular direction. This movement steers the web laterally into the entering span 321 of the drawrolls 309. The guide is mounted on slides or bearings 322, with a point of rotation 323. While this technology may be better than other prior art web guides, it was developed for a moving web, it has several shortcomings when applied to an intermittent machine such as a pouch machine such as locating the nips (from guide rolls 320) in or near the longitudinal sealer section, the web is not guided properly in intermittent motion, and it requires additional framework and additional rack and rail length is required.

Accordingly, a web guide system that uses existing draw rolls is desirable.

SUMMARY OF THE PRESENT INVENTION

According to a first aspect of the invention a pouch machine includes a controller and first and second modules. Each module has a converting station and the electrical equipment needed to operate the station. The controller controls the converting stations. The first module further has an operating parameter input connected to the controller and an operating parameter output. The second module has an operating parameter input, connected to the operating parameter output.

According to a second aspect of the invention a pouch machine has a plurality of modules. Each module includes a converting station and is electrically self-contained. The modules are configured in a daisy-chain. Successive modules receive operating parameters from the preceding module.

According to a third aspect of the invention a method of making a pouch machine includes selecting two modules. Each module has a converting station operatively connected to a central controller. An operating parameter output is provided from the first module to the second module.

A third module, including a converting station, may be connected to the second module, wherein operating parameters are received by the third module in one embodiment.

Various embodiments provide that the first module have an infeed station, and the second and third modules have converting stations that are one (not necessarily the same one) of the group consisting of a zipper sealer station, a long sealer station, a cross sealer station, a cross seal extension station, and a slider station, and a fourth modules may have a cut-off station.

A common user interface for a central controller is provided in another alternative.

According to a fourth aspect of the invention a pouch machine includes two processing zones. Each has a first station along a film path, a registration sensor along the film path, and a drawroll. Each drawroll is responsive to the respective registration sensor The sensor is an optical sensor that detects print registration marks in one alternative.

The processing stations are at fixed locations in another embodiment.

Accumulators are included in each processing zone, and the machine includes a third processing zone that does not have a draw roll in various embodiments.

According to a fifth aspect of the invention a pouch machine includes a plurality of processing devices. An edge sensor senses the edge of the film. A draw roll assembly is mounted on a moveable frame, and is angled in response to the location of the sensed edge. Multiple such assemblies may be included on a single machine.

Other principal features and advantages of the invention will become apparent to those skilled in the art upon review of the following drawings, the detailed description and the appended claims.

Figure 1:
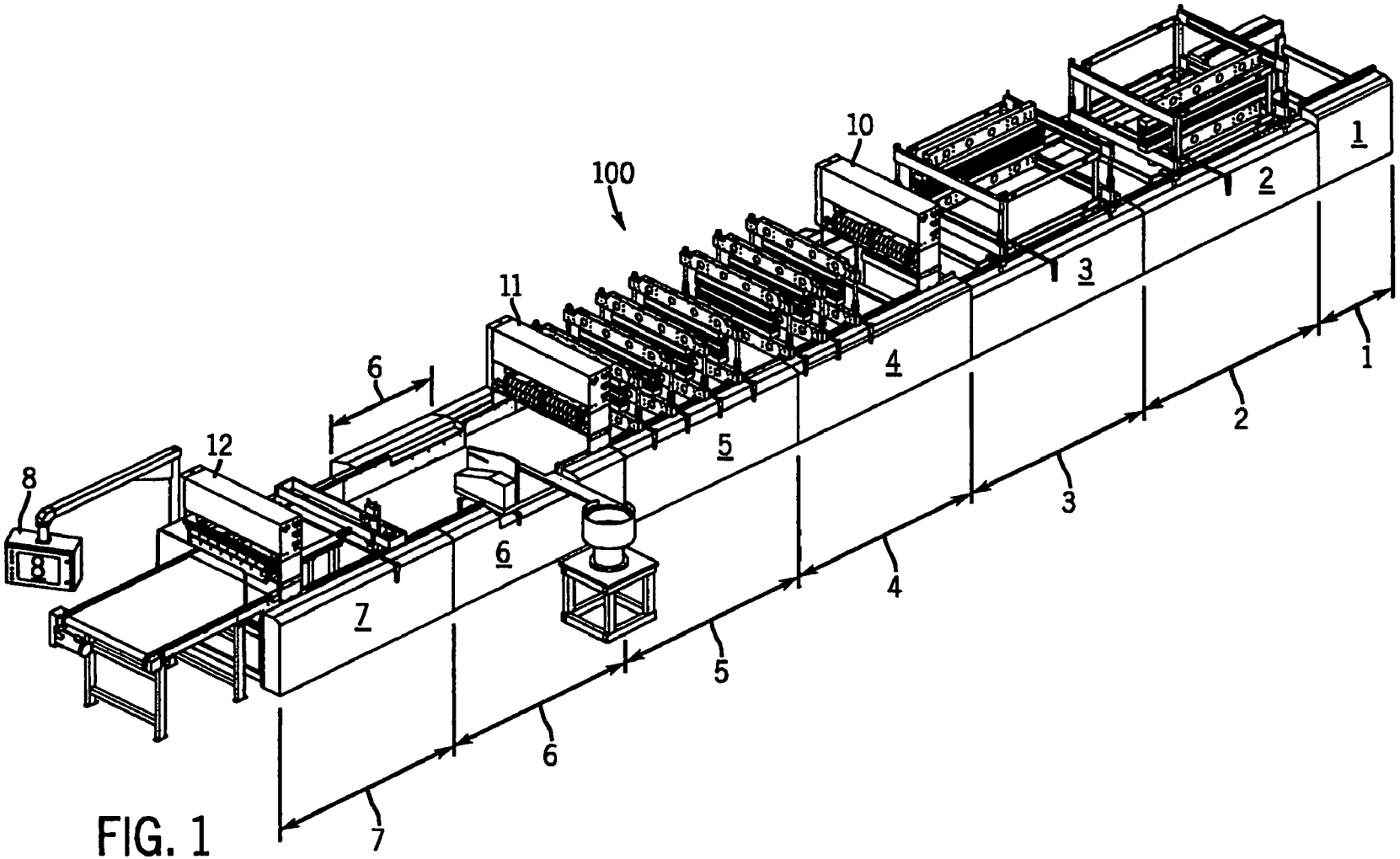
FIG. 1 is diagram of a modular pouch machine in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to particular pouch machines and particular components and configurations, it should be understood at the outset that the invention can also be implemented with other machines, components and configurations.

One aspect of the invention relates to a modular design of a pouch machine converting line. The machine is comprised of several free standing, mechanically and electrically self-contained modular sections. (Electrically self-contained, as used herein, includes a module that has the electrical equipment needed to operate the module, although not necessarily the controller.) Each section is designed to plug in and produce a unique pouch product. This fast, flexible, "plug and play", building block approach, allows for the converting of multiple pouch style products from a single base machine. It also increases the versatility of the base machine to economically adapt to different products in changing markets.

Generally, the invention eliminates the common main cabinet by providing individual cabinets containing all the electrical that is required for that specific modular section of machine. Thus, creating free standing, plug in units that can easily be combined in a variety of configurations to make many different products. The overall machine line is then controlled through fiber optic wires between modules and to the PC based operator interface—the controls are daisy chained.

Another aspect of the invention is providing for multiple drawrolls and registration sensors in the machine to register the devices throughout the machine (described in detail below). (Registration sensor, as used herein, includes a sensor that detects a seal or registration mark on a film, bag or pouch, and may include circuitry, digital and/or analog and hardware and/or software that provides a signal indicating the location of the registration mark, seal, or pouch.) This reduces or eliminates the need for processing devices to be mounted on carriages. This may be combined with the modularity aspect, or implemented separately.

Another aspect of the invention provides for having the drawrolls cooperate with an edge sensor, such that the draw rolls are both drawing the film and guiding the film. The drawrolls are mounted on a moving frame, and are moved to a desired angle to guide the film in a desired direction (in response to the edge sensor). This aspect may be combined with the other aspects, or implemented by itself.

Referring now to FIG. 1, a pouch machine 100 constructed in accordance with the present invention is shown, and includes mechanical and electrical modularity. While a particular configuration is shown, the invention contemplates other configurations may be readily obtained using a arrangement of self-controlled modules.

Module, as used herein, includes a housing in which a processing station is disposed. Self-contained modules, as used herein, includes modules having electrical and mechanical equipment that form a processing station disposed within the module, wherein a controller controls the operation of the processing station by providing operating parameters. Feedback may be provided to the controller from the module. Controller, as used herein, includes a device that controls a processing station, and can include analog and/or digital circuitry, and be implemented with hardware and/or software. Converting or processing station, as used herein, includes the machinery that performs a process on the film, such as sealing, folding, transporting, cutting, forming zippers or sliders, etc.

Pouch machine 100 includes seven modules: an infeed module 1, a zipper sealer module 2, a long sealer module 3, a cross sealer module 4, a cross seal extension module 5, a slider module 6, and a cut-off module 7. Some of the modules, such as 4, 6 and 7, include drawrolls (10, 11 and 12)

Infeed station, as used herein, includes a processing station that receives a film and feeds it to subsequent processing stations, it may include machinery for folding the film. Zipper sealer station, as used herein, includes a processing station that welds or forms a zipper onto a pouch, usually in the machine direction. Long sealer station, as used herein, includes a processing station that forms a machine direction seal. Cross sealer station, as used herein, includes a processing station that forms a cross-seal, such as the seals separating successive pouches. Cross seal extension station, as used herein, includes a processing station that forms cross seals over an extended length. Slider station, as used herein, includes a processing station applies a "slider" onto a pouch, usually in the machine direction. Cut-off station, as used herein, includes a processing station that cuts the film, such as that used to separate adjacent pouches.

Each module has all the mechanical features and machinery required to accomplish it's specific task, along with a specific electrical enclosure to provide power to it's machinery. Power is preferably provided from one module to the next so that they have interconnected power, or it maybe provided individually to each module. (Interconnected power, as used herein, includes modules that share a common power source, such as a power line connecting one module to another.)

A common PC based operator interface 8, will provide the operating parameters and is part of a central controller that controls each of the modules. Common user interface, as used herein, includes a user interface that allows the user to input information for some or all of the processing stations in a pouch machine. PC based, as used herein, includes a user interface using personal computer type processor, screen etc.

Each module provides the operating parameters to the succeeding module on an operating parameter output, and likewise each succeeding module receives the operating parameters on an operating parameter input. The first module receives operating parameters from the central controller and the last module can be connected back to the controller. Operating parameter output, as used herein, includes providing machine operating parameters as an output. Operating parameter input, as used herein, includes receiving operating parameters as an input for controlling a processing station. Operating parameters, as used herein includes parameters used by the controller to control a processing station, such as movement instructions, timing information, speed, distance, processes needed, temperature of seals, dwell time, etc.

The intermediate modules both send and receive operating parameters. (Intermediate modules, as used herein, includes modules other than the first and last modules.) Thus, the modules are connected in a daisy-chain configuration. (Daisy-chain, as used herein, includes connecting each module (other than the first) to a preceding. module, such that operating parameters are passed from module to module, and can include a connection from the last module to the controller, and controller to the first module.) The connection and communications protocol may be SERCOS fiber optic, conventional hard wire communication lines, such as RS 485, wireless protocol, TCP/IP (internet) or other types.

Pouch machine 100, in the configuration of FIG. 1, has all modules and is capable of producing the largest variety of finished pouch products which include a 3-side seal pouch, a 3-side seal pouch with "press-to-close" zipper, a 3-side seal pouch with "slider" zipper, a stand-up pouch, a stand-up pouch with "press-to-close" zipper, and a stand-up pouch with "slider" zipper.

However, these products could be formed using less than all the modules. For example, the modules that would produce a 3-side seal pouch, includes modules 1, 3, 4 & 7. The 3-side seal pouch with "press-to-close" zipper, may be, made with modules 1, 2, 3, 4, 5, & 7. The 3-side seal pouch with "slider" zipper may be made with modules 1, 2, 3, 4, 6 & 7. Stand-up pouches may be made with modules 1, 3, 4 & 7. The stand-up pouch with "press-to-close" zipper may be made with modules 1, 2, 3, 4, 5 & 7. The stand-up pouch with slider zipper may be made with modules 1, 2, 3, 4, 6 & 7.

Thus, if a pouch manufacture desires to make a 3-side seal pouch he need only purchase modules 1, 3, 4 and 7. Should he desire later to enter the 3-side seal with a press to close zipper market, he need only buy the additional modules. Other advantages of this invention include the machine footprint being less wide compared to prior art units having a free standing main electrical enclosure, standard modules can be manufactured cost effectively, and customers do not need to know exactly which pouch market they are targeting because they can buy a basic machine and add modules to it as their needs change, cost effectively, and field conversions are cost effective.

Figure 2:
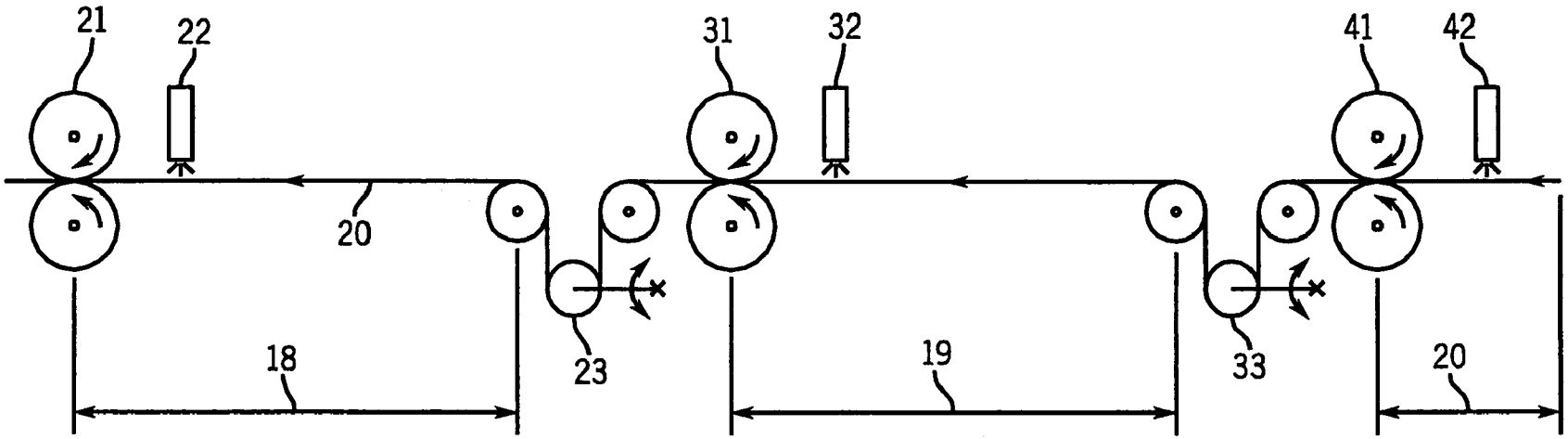
FIG. 2 is a diagram of a pouch machine having multiple drawrolls in accordance with the present invention.
Figure 3:
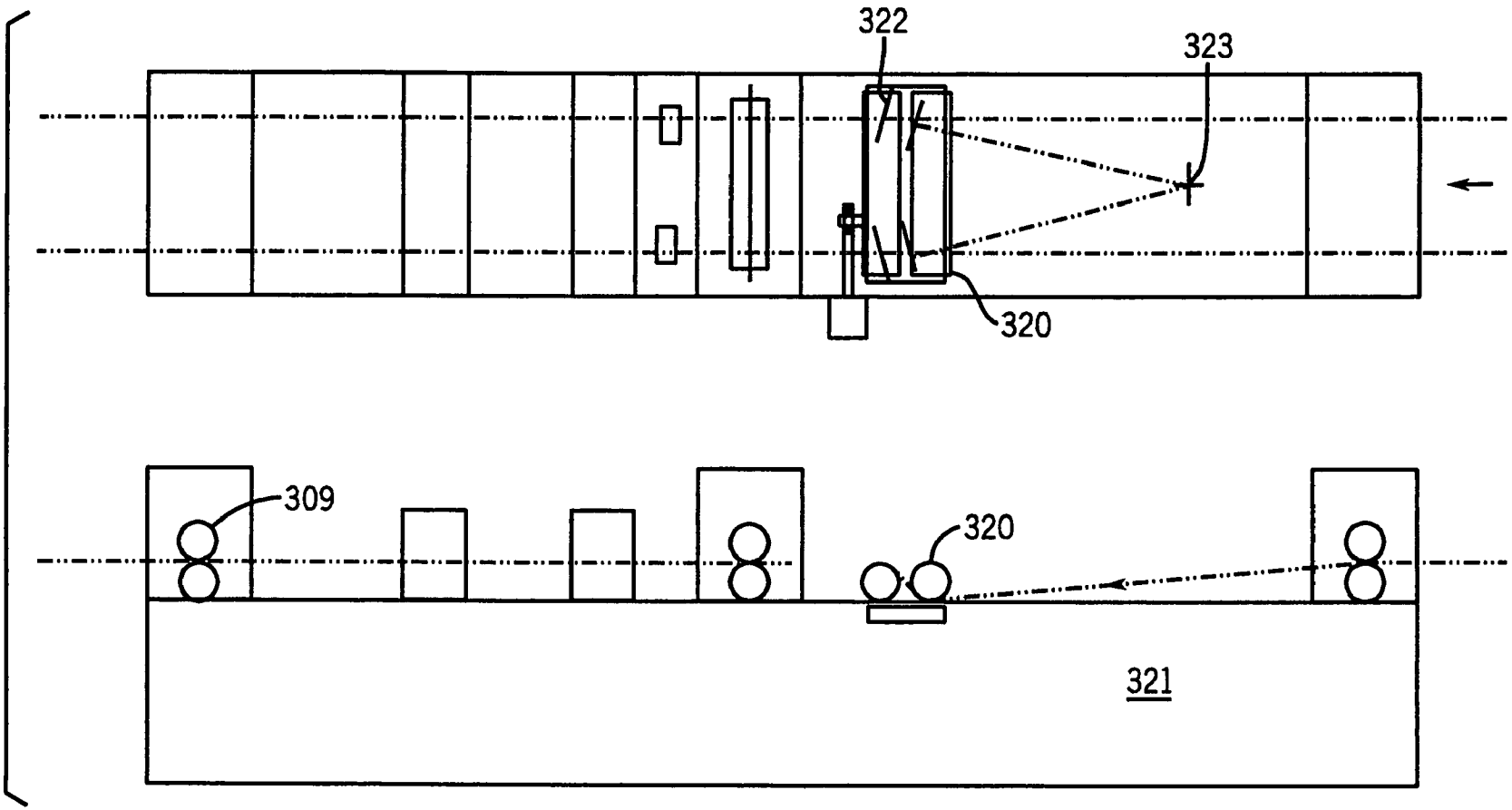
FIG. 3 PRIOR ART
FIG. 3 is a prior art web guide.

Referring now to FIG. 2, multiple draw rolls are shown in gloater detail. Drawroll, as used herein, includes a roll or plurality of driven rolls that drive the film, pouch, or bag.

Processing zones 18, 19 and 20, may be processing zones such as those shown in FIG. 1 (the processing machinery is omitted in FIG. 2). Each zone is provided with a drawroll (21, 31, and 41) and an optical sensor or photo-eye (22, 32 and 42). Optical sensor, as used herein, includes a sensor such as photo cell that detects an optical mark, seal, bag or pouch.

The controller uses the detection from the photo-eye to control each draw roll to register the web to the processing device. Each photo eye detects the presence of a printed registration mark (or seal etc.) on web or film 20. Each drawroll is responsive to the optical sensor or registration sensor, and advances web 20 to a registered stop position determined by the respective photo eye within the respective zone. Responsive to a registration sensor, as used herein, includes processing the film such that the process is registered to the mark, seal, or pouch.

Web length variations that occur between drawrolls due to inconsistent printing or other problems will be taken up by accumulators 23 or 33. Accumulator, as used herein, includes rolls or other devices that adjust the film path length.

The processing devices need not be mounted on carriages to register to the film or mark, and are at fixed locations (they still move toward or way from the web or be positioned manually). Processing station at a fixed location, as used herein, includes a station that does not move automatically along the film path to register the station to the film, mark, seal, pouch or bag.

Additional registration zones as described above could be provided. The registration accuracy of any process (cross sealing, punching, die cutting, etc.) will be greatly improved due to the short length of web which is brought to register within each zone. Referring to FIG. 1, it can be seen that the film path extends from zones 4, 5, 6 and 7, three of which have drawrolls. Thus, the overall length between drawrolls and registration is greatly reduced compared to having a single drawroll. Film path extending from one zone to a second other zone, as used herein, includes the film passing from the first zone, and either directly to the second zone, or first passing through a third zone, and then passing to the second zone.

Figure 4:
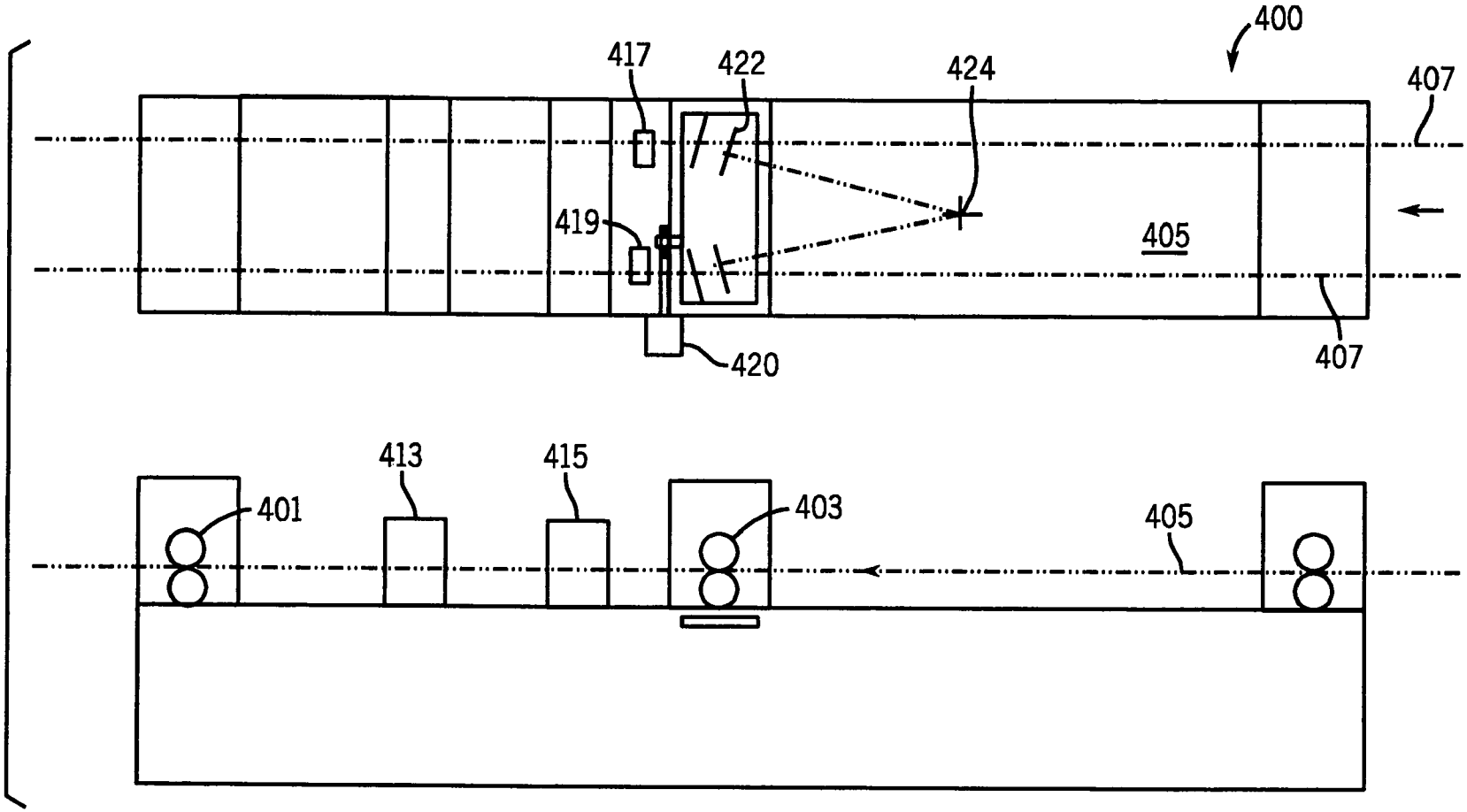
FIG. 4 is a web guide in accordance with the preferred embodiment.

Referring now to FIG. 4, a diagram of a web guide in accordance with the preferred embodiment is shown. It may be implemented without the other aspects of this invention, or it may be combined with them. FIG. 4 shows a machine 400, including drawrolls 401 and 402 (they may be drawrolls 21, 31 or 41 from FIG. 2). Processing stations 413 and 415 may be any of the processing stations described above. Drawroll 402 acts as a web guide (drawroll 401 can do so as well, although the detail is omitted in FIG. 4.)

A web or film 405 passes through machine 400 and edges 407 of web 405 are accurately held in a desired location. Web 405 is guided such that wrinkling is eliminated or reduced of the web is done without the system continuously "hunting" for the web edge. The web guiding system steers the web during the during the draw or feed cycle of the web and includes edge sensors 417 and 419. Sensors 417 and 419 sense the position of one edge or both edges 407 of web 405 depending on whether the web is edge-guided or center-guided, and send a signal to a prime mover 420, whether electric motor, hydraulic or pneumatic cylinder, electro-mechanical actuator or other device and angular re-position the movable drawroll assembly. (Drawroll assembly, as used herein, includes the structure on which a drawroll is (or plurality of drawrolls are) mounted.)

Edge sensor 26 are preferably mounted downstream of the movable drawroll in a fixed position while the machine is running. Edge sensor, as used herein, includes a sensor such as an optical sensor that locates the edge of a film or web, or locates a mark on the web from which the location of the edge of the web may be inferred.

The invention may be implemented with existing center-guiding technology, and the sensors can be mounted so that both sensors are movable toward and away from each other automatically as the web or sheet width changes.

Once a change in the edge(s) of the web (or printed line of the web) is detected, electronic circuitry sends a signal to prime mover 420 of the guiding system. This signal controls the direction of movement of prime mover 420 depending on the direction of movement of the web or sheet.

In the preferred embodiment intermittently driven drawrolls 403 are mounted on a sub-frame or drawroll frame which in turn is mounted on shafts and bearings 422 so as to move in an arc motion. This arc motion has a point of rotation 424 located several inches upstream of the drawrolls. As the prime mover is actuated, it will move the drawrolls in an arc motion transverse to the web travel, or be angled in either direction away from the machine direction. (Angled in either direction away from machine direction, as used herein, includes angled to the left or right (in a horizontal plane) sufficient to steer the web.)

This arc motion is possible due to the shafts and support bearings which support the drawrolls being positioned at an angle to the web. As the drawrolls are moved by the prime mover the direction of draw and thus the position of the web is guided or steered accordingly, keeping the web edge in line with the machine edge. (Direction of draw, as used herein, includes the direction a drawroll draws and pushes a film or web.)

Numerous modifications may be made to the present invention which still fall within the intended scope hereof. Thus, it should be apparent that there has been provided in accordance with the present invention a method and apparatus for a pouch machine that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A pouch machine comprising:

a controller that provides a plurality of control signals;

a first module, including a first converting station, wherein the controller is operatively connected to the first converting station which receives the plurality of control signals, and wherein the first module further includes a plurality of operating parameter outputs, including an operating speed output; and a second module, including a second converting station, wherein the second module further includes a second plurality of operating parameter inputs, connected to the plurality of operating parameter outputs such that the controller is operatively connected to the second converting station solely through the first module, and wherein the second plurality of operating parameter inputs further includes an operating speed input connected to the operating speed output, wherein the second module receives a film from the first module and wherein the second module is responsive to the speed input and the second operating parameter input.

2. The pouch machine of claim 1, further comprising a third module, including a third converting station, wherein the third module further includes a third plurality of operating parameter inputs and the second module further includes a second plurality of operating parameter outputs, connected to the third plurality of operating parameter inputs such that the controller is operatively connected to the third converting station solely through the second module, wherein the third plurality operating parameter inputs include a second operating speed input and the second plurality of operating parameter outputs include a second operating speed output, connected to the second operating speed input.

3. The pouch machine of claim 2 wherein:

the first converting station is an infeed station;

the second converting station is one of the group consisting of a zipper sealer station, a long sealer station, a cross sealer station, a cross seal extension station, and a slider station; and the third converting station is one of the group consisting of a zipper sealer station, a long sealer station, a cross sealer station, a cross seal extension station, and a slider station.

4. The pouch machine of claim 3, further comprising a fourth module, including a cut-off station, wherein the fourth module further includes a plurality of fourth operating parameter inputs and the third module further includes a third plurality of operating parameter outputs, connected to the fourth plurality operating parameter inputs such that the controller is operatively connected to the fourth converting station solely through the second module, wherein the fourth plurality of operating parameter inputs include a third operating speed input and the third plurality of operating parameter outputs include a third operating speed output, connected to the third operating speed input.

5. The pouch machine of claim 3, wherein the first, second and third modules have interconnected power.

6. The pouch machine of claim 1, further comprising a common user interface.

* * * * *